US005604995A

United States Patent [19]

Lehtinen et al.

[11] Patent Number: 5,604,995

[45] Date of Patent: Feb. 25, 1997

[54] WIRE SEAL FOR A DRYING SPACE IN A DRYING APPARATUS

[75] Inventors: Jukka Lehtinen; Paavo Rautakorpi, both of Tampere; Seppo Haavisto, Hämeenkyrö, all of Finland

[73] Assignee: Valmet-Tampella Oy, Tampere, Finland

[21] Appl. No.: 236,452

[22] Filed: May 2, 1994

[51] Int. Cl.[6] ..... F26B 5/04

[52] U.S. Cl. ..... 34/417; 34/242

[58] Field of Search ..... 34/242, 417

[56] References Cited

U.S. PATENT DOCUMENTS

| | | | |
|---|---|---|---|
| 2,459,295 | 1/1949 | Skoog | 34/242 |
| 2,932,183 | 4/1960 | Richeson | 34/242 |
| 2,954,687 | 10/1960 | Yazawa et al. | 34/242 |
| 2,986,911 | 6/1961 | Jackson | 34/242 |
| 3,084,448 | 4/1963 | Dungler | 34/242 |
| 3,098,260 | 7/1963 | Richeson | 34/242 |
| 4,112,586 | 9/1978 | Lehtinen | 34/9 |

*Primary Examiner*—Henry A. Bennett
*Assistant Examiner*—Dinnatia Doster
*Attorney, Agent, or Firm*—Ladas & Parry

[57] ABSTRACT

The invention relates to wire seals for use in a drying space of a Condebelt® drying apparatus described in Finnish Patent 54 514. In the apparatus, a material web to be dried passes in a substantially airless space between two metal bands (1, 7), or other similar bands or membranes of good thermal conductivity, together with drying wires. One of the metal bands is arranged to heat and the other is arranged to cool; the heating band (1) evaporates moisture contained in the web (2) to be dried, the moisture condensing on the surface of the cooling band (7), separated from the web to be dried by drying wires (3, 4). The drying space between the bands (1) and (7) of the Condebelt® apparatus is sealed up at the edges by seals integral with the coarse wire (4) either such that the wire is partly filled close to its edges with sealant stripes (5) extending longitudinally of the wire and being usually slightly thicker than the coarse wire, or such that the seal profiles (9) or strips are attached close to the wire edges or to the wire edges by sewing, vulcanizing, gluing, or a combination of these ways of attachment. (FIG. 1)

3 Claims, 1 Drawing Sheet

WIRE SEAL FOR A DRYING SPACE IN A DRYING APPARATUS

This invention relates to seals for use at the edges of a drying space of a Condebelt® drying apparatus described in Finnish Patent 54 514.

In the above-mentioned drying apparatus a material web to be dried is in a substantially airless space between two metal bands together with drying wires. One of the metal bands is arranged to heat and the other is arranged to cool; the heating band evaporates moisture contained in the web to de dried, and the moisture then condenses on the surface of the cooling band. The drying wires keep the web to be dried apart from the condensing moisture, which remains on the surface of the cooling band and in the drying wires. There are usually two drying wires, of which the coarser one is positioned against the cooling metal band, while the more fine-textured wire is positioned between the coarse wire and the web.

As the pressure between the metal bands is usually relatively low as compared with ambient pressure, and the wires also leak in the sideward direction, it is necessary to seal up the space between the bands at the edges to prevent leakages. Particularly air leakages in between the bands deteriorate drastically the operation of the drying process. In addition, steam leakages in between the bands are very undesirable as they moisten the web to be dried and may thus disadvantageously increase the pressure prevailing between the bands.

In Finnish Patent 54 514 the seal is shown schematically by a rectangle 23 drawn between the band edges, and a similar representation is to be found in the brochures advertising Condebelt®. However, the more accurate operation or structure of the seal has not been disclosed due to the lack of test results, among other things.

A seal structure based on positioning the seal in conjunction with the coarse wire has been used successfully in the tests carried out. The seal is preferably made by filling a longitudinal zone in the coarse wire close to its edge with a suitable sealant, such as rubber or plastic. The best result will be obtained if the sealant zone is slightly thicker than the coarse wire alone, and grooved slightly in the longitudinal direction. An alternative way to realize a seal for use in conjunction with the wire is to attach a suitable seal profile to the edge of the wire by gluing, vulcanizing or mechanically, e.g. by sewing.

The seal according to the invention is characterized in that the drying space between the belts 1 and 7 of the Condebelt® apparatus is sealed up at the edges by seals integral with the coarse wire 4 either by partly filling the wire close to its edges by sealant stripes extending longitudinally of the wire and being usually slightly thicker than the coarse wire, or by attaching the seal profiles or strips close to the wire edges or to the edges by sewing, vulcanizing, gluing, or a combination of these ways of attachment.

In the following the invention will be described more fully with reference to the figures, which show the edge area of the bands of a Condebelt® dryer in cross section.

DESCRIPTION OF PREFERRED EMBODIMENTS

Figure 1:
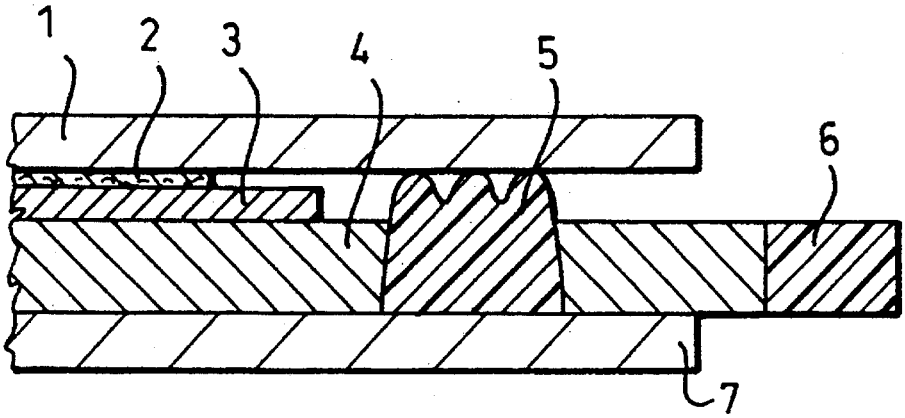
FIG. 1 is a trans-axial elevation in cross section and cut away to show only one right side of a first embodiment.

FIG. 1 shows a seal according to the invention made by providing a coarse wire with a sealant stripe longitudinally of the wire; for the sake of clarity, the seal is enlarged in the vertical direction about five times greater.

Figure 2:
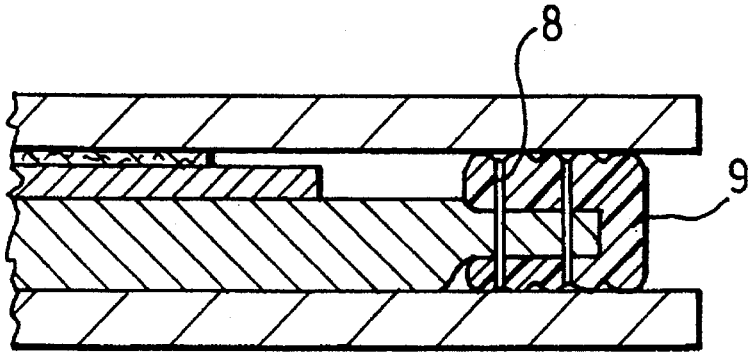
FIG. 2 is a trans-axial elevation in cross section and cut away to show only one right side to a second embodiment.

FIG. 2 shows a seal according to the invention consisting of an elastomer profile attached to the edge of the wire.

The solution shown in FIG. 1 comprises a heating upper band 1, a web 2 to be dried, a fine wire 3, a cooling lower band 7, and a coarse wire 4 with a seal 5 and an edge filling 6. The seal 5 has been made by extruding suitable material into the wire to form a longitudinal zone close to the edge of the wire. The drying space to be sealed up is defined between the metal bands 1, 7 and the seals 5. The seal 5 may be positioned in close vicinity to the edge of the coarse wire 4, so that there is no need for a separate edge filling 6, which is intended mainly to reinforce the edge of the wire and prevent its unravelling. The extrusion of sealant may be technically difficult, and there may remain faults at points where the extrusion is started and ended. In some cases, it may therefore be advisable to make a number of seals 5 side by side so that the starting and ending points of the seals are remote from each other, and so one inferior section will not affect the sealing effect significantly.

The sealing may also be made in such a way that the edge filling 6 extends up to the seal 5, and so far sidewardly and outwardly that is can be used as a slide seal for the edge of a water table positioned under the band 7. Furthermore, the seal 5 may have a width such that it can likewise be used as a slide seal for the edge of a water table, whereby the edge filling 6 is not needed.

In the solution shown in FIG. 2 the seal consists of a seal profile 9, which is attached to the edge of the coarse wire. The attachment is made by a seam 8 or by rivets driven through the profile and the wire. The attachment can be further secured or it can be replaced by gluing or vulcanizing.

The seal may also be realized by combining the above-described ways, whereby the wire is filled close to its edge by a filler material, and sealing strips, or a sealing strip bent into U-shape around the edge of the wire, is attached to the wire and the filler by sewing, riveting, vulcanizing, gluing, or their combination.

The seals may be made of elastomers, such as EPDM rubber, or AFLAS™ fluoroelastomer; certain polyurethanes may also be used. A reinforcing fabric may be cast within the seal profile 9.

In principle, this type of seal can also be constructed in the fine wire 3, but it is not equally easy to realize, and the result is not as good as that obtained by a seal in conjunction with the coarse wire. The Condebelt® apparatus may also be realized by a single wire if the wire is made such that its upper surface is sufficiently smooth and it is thick enough and open at the lower surface for entraining condensed water so that it will not rewet the web 2 to be dried. In this case, the seal is, of course, formed in the single wire in the same way as it is formed in the coarse wire. If there are more than two wires, it is preferable, though perhaps not necessary, to form the seal 5 or 9 in conjunction with the thickest wire.

As used herein, the term metal band 1, 7 does not only refer to bands made of metal but also to other structures and materials of good thermal conductivity, such as various compacted wire mesh structures and solutions utilizing carbon fibre.

We claim:

1. In a drying apparatus in which a web to be dried passes in a substantially airless space between two bands together with at least a first drying wire, one of the bands being arranged to be heated and the other being arranged to be cooled, the web being positioned against the heating band for evaporating moisture contained in the web, the moisture condensing on the cooled band which is separated from the web by the first drying wire, wherein the improvement comprises a seal between an edge of the heating band and a corresponding edge of the cooling band to prevent leakages thereat between a drying space defined by the bands and a surrounding space comprising the seal being combined with the first drying wire, wherein the seal comprises a sealant filling a portion of the first drying wire close to an edge of the first drying wire and a U-shaped seal bent around the edge of the first drying wire to cover the filled portion of the first drying wire and attached to the first drying wire by at least one of sewing, riveting, vulcanizinng and gluing.

2. In a drying apparatus in which a web to be dried passes in a sustantially airless space between two bands together with at least a first drying wire, one of the bands being arranged to be heated and the other being arranged to be cooled, the web being positioned against the heating band for evaporating moisture contained in the web, the moisture condensing on the cooled band which is separated from the web by the first drying wire, wherein the improvement comprises a seal between an edge of the heating band and a corresponding edge of the cooling band to prevent leakages thereat between a drying space defined by the bands and a surrounding space comprising to seal being combined with the first drying wire, and further comprising a filling on an edge of the first drying wire and along the seal.

3. In a drying apparatus in which a web to be dried passes in a substantially airless space between two bands together with at least a first deying wire, one of the bands being arranged to be heated and the other being arranged to be cooled, the web being positioned against the heating band for evaporating moisture contained in the web, the moisture condensing on the cooled band which is separated from the web by the first drying wire, wherein the improvement comprises a seal between an edge of the heating band and a corresponding edge of the cooling band to prevent leakages thereat between a drying space defined by the bands and a surrounding space comprising the seal being combined with the first drying wire, and further comprising a second drying wire layered between the first wire and the web, the first drying wire being course as compared to the second drying wire.

* * * * *